US006357633B1

(12) United States Patent
Zimmerhackel et al.

(10) Patent No.: US 6,357,633 B1
(45) Date of Patent: Mar. 19, 2002

(54) FAST OPENING AEROSOL VALVE

(75) Inventors: Franz Zimmerhackel, Hattersheim; Gerd Brachmann, Idstein, both of (DE)

(73) Assignee: Precision Valve Corporation, Yonkers, NY (US)

( * ) Notice: Subject to any disclaimer, the term of this patent is extended or adjusted under 35 U.S.C. 154(b) by 0 days.

(21) Appl. No.: 09/618,180

(22) Filed: Jul. 18, 2000

(51) Int. Cl.[7] ..... B65D 83/00

(52) U.S. Cl. ..... 222/402.1; 222/402.24; 222/402.25

(58) Field of Search ..... 222/402.1, 402.21, 222/402.24, 402.25

(56) References Cited

U.S. PATENT DOCUMENTS 3,806,005 A * 4/1974 Prussin et al. ..... 222/402.16
4,322,037 A * 3/1982 Heeb et al. ..... 239/337
4,396,152 A * 8/1983 Abplanalp ..... 239/337
5,752,631 A * 5/1998 Yabuno et al. ..... 222/402.1
5,915,598 A * 6/1999 Yazawa et al. ..... 222/402.1
6,039,306 A * 3/2000 Pericard et al. ..... 251/353
6,070,770 A * 6/2000 Tada et al. ..... 222/635

FOREIGN PATENT DOCUMENTS

FR 0325519 A1 * 7/1989 ..... B65D/83/14

* cited by examiner

*Primary Examiner*—Kevin Shaver
*Assistant Examiner*—Frederick C Nicolas
(74) *Attorney, Agent, or Firm*—Kilgannon & Steidl

(57) ABSTRACT

The improved aerosol valve of this invention comprises a gasketed integral valve stem and valve body wherein the stem orifice is disposed at the portion of the valve stem adjacent the upper surface of the valve body in a gasket-receiving groove that has an arcuate lower portion and an upper tapered shoulder portion.

9 Claims, 2 Drawing Sheets

FAST OPENING AEROSOL VALVE

This invention generally relates to a valve for a pressurized aerosol container, which valve has a very limited vertical travel path to reach the full open position.

BACKGROUND OF THE INVENTION

Aerosol containers are widely used to package a variety of fluid materials, both liquid and powdered particulate products. Typically, the product and a propellant are confined within the container, at above atmospheric pressure, and the product is released from the container by manually opening a dispensing valve to cause the pressure within the container to deliver the product through the valve and connecting conduits to a discharge orifice.

The dispensing valve, crimped to a mounting cup having a sealing gasket, is normally mounted in a top opening of the container, which opening is defined by a component commonly referred to as the "bead" of the container opening. The mounting cup includes a central pedestal portion for holding the dispensing valve, a profile portion extending outward from the pedestal portion, which profile portion merges into an upwardly extending body portion, the body portion emerging into a hemispherically-shaped channel portion terminating in a skirt portion, which channel portion is configured to receive the bead portion of the container opening. The sealing gasket normally is disposed within the channel portion and in many gasket configurations extends downward along a part of the body portion. After the sealing gasket is disposed onto the mounting cup, the cup is positioned onto the container and the cup is clinched to the container. The clinching operation is well-known to those skilled in the aerosol container art.

The aerosol dispensing valve generally comprises a hollow valve stem having a wider base portion integral therewith, generally referred to as the valve stem body. Positioned intermediate the valve stem and valve stem body is a valve stem groove. A valve housing surrounds the valve stem body, and is crimped and held within the pedestal portion of the mounting cup. A spring is disposed between the bottom of the valve housing and the underside of the valve stem body, and, in many instances, a hollow tube (dip tube) extends from the outside base of the valve housing to the bottom of an associated aerosol container.

The valve stem groove has one or more opening(s) or orifice(s) extending through the valve stem groove wall and communicating with the conduit in the hollow valve stem. An annular valve sealing gasket with a central opening for receiving the valve stem is positioned in the annular valve stem groove, with the orifice(s) within the groove being positioned such that the gasket seals the orifice(s) when the valve is in the closed position. When the valve is opened by vertically depressing the valve stem, the valve stem moves axially downwardly from its closed position to cause the orifice(s) in the annular valve stem groove to move out of registry or sealing relation with the gasket. Product in the aerosol container then, under the influence of the pressure generated by the propellant, passes upwardly through the dip tube into the valve housing, then through the orifice(s) in the annular valve stem groove into the hollow valve stem, and outwardly through an outlet nozzle in an actuator button, cap or spout mounted atop the valve stem.

Heretofore, most commercial vertically-actuated aerosol valves have had a stroke path of 0.8 mm to 1.0 mm in order to achieve a full spray rate.

Recently, marketers of aerosol products, as well as consumers, have sought an aerosol package wherein the product is delivered from the container after a very short stroke. Both marketers and consumers equate a short valve opening stroke to easy actuation of the aerosol valve. Further, with prior aerosol valves, the actuation stroke could be monitored to partially open the valve through controlling the depression of the valve stem to less than full depression. Such partial depression of the valve stem prevents a full spray rate and often results in a spray that is undesirably coarse or dripping.

The applicant is aware of a commercial aerosol valve that has a short stroke in order to fully open the valve. The structure of this valve comprises a valve body having a centrally disposed hollowed-out portion in its top surface and a separately molded valve stem having orifice slots at its base, which valve stem extends into the valve body; the result being that the orifice slots sit beneath the sealing gasket disposed about the valve stem and atop the valve body. Depression of the valve stem immediately separates the underside of the gasket from the top surface of the valve body and the propellant/product within the container may pass through the space between the underside of the gasket and the top surface of the valve housing into the hollowed-out portion of the valve body and into the slots in the valve stem. One difficulty with the above-described aerosol valve is that it requires an assembly operation to combine the valve body and valve stem. Additionally, the above-described aerosol utilizes a straight shank stem. Straight shank stems are more difficult to properly seal with a surrounding gasket; said stems being prone to side spitting. Moreover, straight shank stems are prone to having the gasket drag above the valve stem orifice during the closing of the valve and, thus, closing slowly or not at all, particularly where, the product/propellant system in the aerosol container causes substantial swelling of the gasket.

SUMMARY OF THE INVENTION

An object of the invention is to provide an integral (one-piece) aerosol valve stem/valve body having a valve stem orifice sealed by a surrounding gasket, which valve is fully opened upon a relatively short vertical actuation stroke.

The improved aerosol valve of this invention comprises a gasketed integral valve stem and valve body wherein the stem orifice is disposed at the portion of the valve stem adjacent the upper surface of the valve body in a gasket-receiving groove that has an arcuate lower portion and an upper tapered shoulder portion.

IN THE DRAWINGS

DETAILED DESCRIPTION OF THE INVENTION

Figure 1:
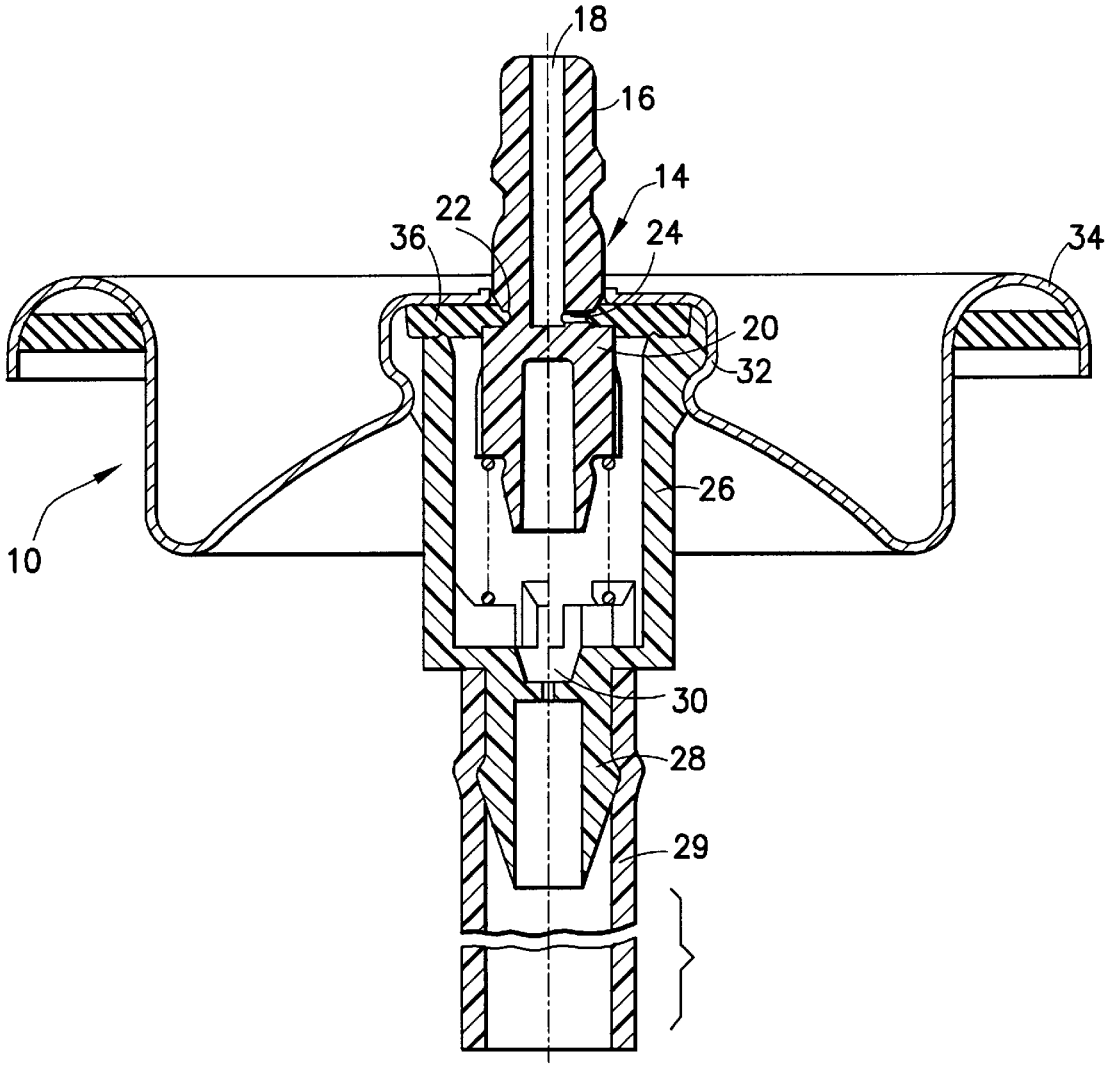
FIG. 1 is a cross-sectional view of the aerosol valve assemblage of this invention, showing the valve stem and valve body configuration of this invention.

FIG. 1 illustrates an aerosol valve assembly generally designated as (10). More specifically, the valve assembly includes an integrated valve stem/valve body, generally designated as (14), said valve stem/valve body having a valve stem portion (16) with a conduit (18) therethrough; a valve body portion (20) and an annular groove (22) (shown in detail in FIG. 2); said groove (22) having a stem orifice (24) through the wall of the groove portion and interconnecting with the conduit (18). Surrounding the valve body (20) is a valve housing (26), said valve housing having an extending nipple (28) with a conduit (30) therethrough; the nipple (28) being designed to receive a dip tube (29) (shown in partial section). The valve housing (26) is crimped within the pedestal portion (32) of a mounting cup (34) (shown in partial section). Encircling the valve stem (16) and disposed within the groove (22) is an annular gasket (36); said gasket acting to seal orifice (24) when the valve is in a closed position. To complete the valve assembly, an actuator (not shown) with the appropriate conduits leading to a discharge orifice is disposed atop the valve stem (16).

Figure 2:
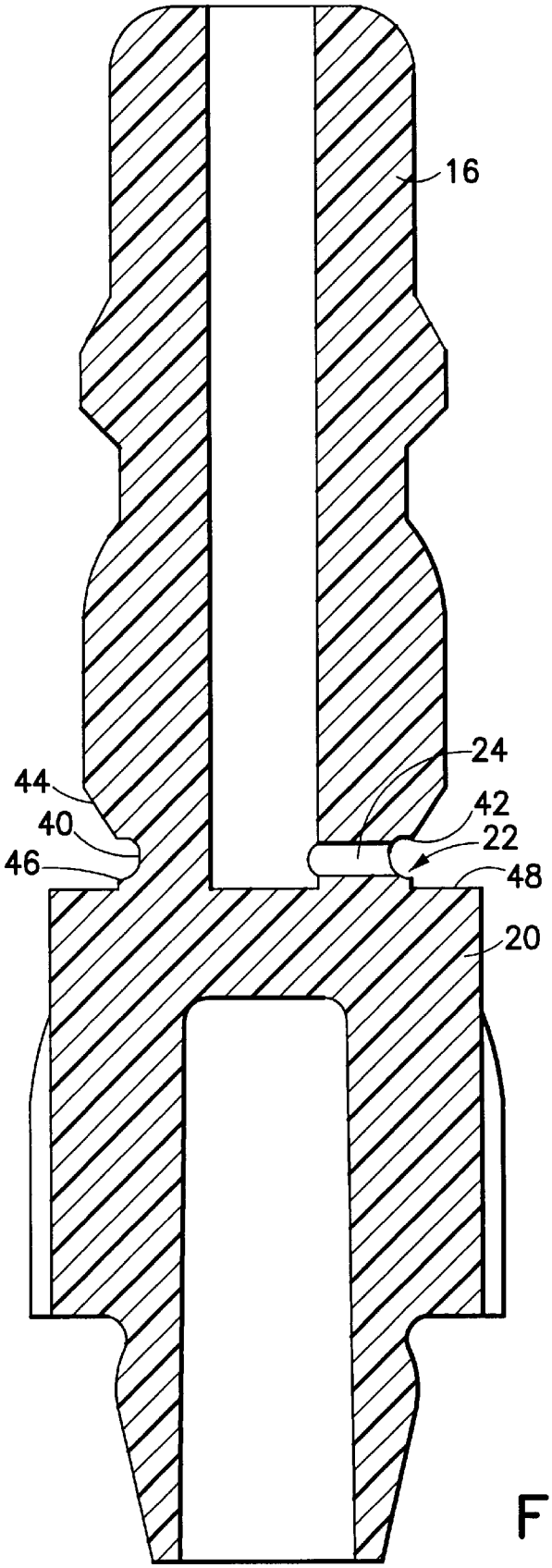
FIG. 2 is an enlarged cross-sectional view of the valve stem and valve body of this invention.

FIG. 2 shows, in enlarged detail, the novel and inventive valve stem and valve body of this invention.

In FIG. 2, a valve stem (16) is disposed atop an integral valve body (20). The novel structural elements of the valve stem/valve body concern the shape of the groove (22) and its placement relative to the valve body (20).

The groove (22) has an arcuate portion (40) terminating at its upper portion (42) in an upwardly and outwardly extending tapered shoulder (44). The outer terminus of the stem orifice (24) is through the arcuate portion (40) of the groove (22); most preferably through the center of the arcuate portion (40). The terminus of the lower end (46) of the arcuate portion (40) is slightly above the top surface (48) of the valve body (20).

It has been found that having the upper portion of the gasket receiving groove of the valve stem terminating in an upwardly and outwardly extending tapered shoulder is critical to obtaining a full and fast spray without dripping of the discharged spray. Having the groove completely arcuate resulted in a valve not fully opening upon initial actuation and, in some instances, there was dripping of the discharging spray.

It has been found that a groove and valve stem orifice having the following dimensions will produce a fast opening valve with satisfactory spray characteristics:

(a) upper taper portion=30°

(b) upper taper portion length=0.029 inch (c) radius of upper arcuate portion=0.005 inch radius of lower arcuate portion=0.010 inch (d) height of arcuate portion=0.020 inch (e) valve stem orifice diameter=0.013 inch (f) space between lower terminus of arcuate portion of valve stem and top surface of valve body=0.001 inch.

The gasket used with the above-denoted groove of the valve stem had the following parameters:

(a) gasket thickness=0.046 inch (b) gasket inner diameter=0.102 inch.

Expectedly, the components indicated below could vary in dimension as stated:

(a) taper angle of upper tapered portion of groove: 15° to 45°

(b) stem orifice diameter: 0.010 inch to 0.024 inch (c) gasket thickness: 0.040 inch to 0.060 inch.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. In an aerosol valve comprising a mounting cup including a pedestal portion for affixing thereto a valve housing, said housing surrounding an integral valve stem having a conduit therethrough and a valve body having an upper surface, the valve stem/valve body being capable of vertical reciprocation within said valve housing; said valve stem having a gasket-receiving groove thereon, which groove has a stem orifice radially extending through the inner wall of said groove and communicating with the conduit in the valve stem and a sealing gasket disposed within said groove on the valve stem and sealing the stem orifice when the valve is in a closed position, the improvement comprising said gasket-receiving groove having a portion thereof having upper and lower arcuate components which upper arcuate component at its upper terminus merges into an outwardly and upwardly tapered portion and further wherein the lower terminus of the lower arcuate component is adjacent to, but spaced from, the upper surface of the valve body.

2. The improved aerosol valve of claim 1, and further wherein the upper tapered portion of the gasket-receiving groove in the valve stem has an angle from about 15° to about 45°.

3. The improved aerosol valve of claim 1, and further wherein the lower terminus of the arcuate portion of the groove in the valve stem is not greater than about 0.004 inch above the upper surface of the valve body.

4. The improved valve of claim 1, and further wherein the valve stem orifice has a diameter from about 0.004 inch to about 0.024 inch.

5. The improved aerosol valve of claim 2, and further wherein the upper tapered portion of the gasket-receiving groove has an angle of about 30°.

6. The improved valve of claim 5, and further wherein the valve stem orifice has a diameter of about 0.013 inch.

7. The improved valve of claims 2 or 3, and further wherein the lower terminus of the arcuate portion of the groove in the valve stem is not greater than about 0.004 inch above the upper surface of the valve body.

8. The improved valve of claims 2, 3, 5 or 6, and further wherein the lower terminus of the arcuate portion of the groove in the valve stem is not greater than about 0.004 inch above the upper surface of the valve body.

9. The improved valve of any one of the preceding claims, and further wherein the upper portion of the arcuate portion of the groove has a substantially lower radius of curvature than the lower portion of the arcuate portion of the groove.

* * * * *